US010569120B2

(12) United States Patent
Sorin et al.

(10) Patent No.: US 10,569,120 B2
(45) Date of Patent: Feb. 25, 2020

(54) WEIGHT-BALANCED EXERCISE APPARATUSES AND METHODS OF USING SAME

(71) Applicants: Albert Sorin, Lexington, SC (US); Richard Sorin, Lexington, SC (US)

(72) Inventors: Albert Sorin, Lexington, SC (US); Richard Sorin, Lexington, SC (US)

( * ) Notice: Subject to any disclaimer, the term of this patent is extended or adjusted under 35 U.S.C. 154(b) by 180 days.

(21) Appl. No.: 15/420,988

(22) Filed: Jan. 31, 2017

(65) Prior Publication Data

US 2017/0136283 A1 May 18, 2017

Related U.S. Application Data

(63) Continuation-in-part of application No. 14/699,971, filed on Apr. 29, 2015, now Pat. No. 9,573,014.

(51) Int. Cl.

| | |
|---|---|
| ***A63B 21/072*** | (2006.01) |
| ***A63B 21/00*** | (2006.01) |
| *A63B 21/06* | (2006.01) |

(52) U.S. Cl.

CPC ..... *A63B 21/072* (2013.01); *A63B 21/4035* (2015.10); *A63B 21/0004* (2013.01); *A63B 21/00065* (2013.01); *A63B 21/06* (2013.01); *A63B 21/0601* (2013.01); *A63B 21/0604* (2013.01); *A63B 21/0608* (2013.01); *A63B 21/0724* (2013.01); *A63B 21/0726* (2013.01); *A63B 21/151* (2013.01); *A63B 21/4019* (2015.10); *A63B 21/4023* (2015.10); *A63B 21/4025* (2015.10); *A63B 21/4033* (2015.10); *A63B 21/4043* (2015.10); *A63B 2244/14* (2013.01)

(58) Field of Classification Search

CPC . A63B 21/0004; A63B 21/06; A63B 21/0601; A63B 21/0604; A63B 21/0608; A63B 21/072; A63B 21/0724; A63B 21/0726; A63B 21/4019; A63B 21/4023; A63B 21/4025; A63B 21/4033; A63B 21/4035; A63B 21/4043; A63B 2244/14

See application file for complete search history.

(56) References Cited

U.S. PATENT DOCUMENTS

| | | | |
|---|---|---|---|
| 113,966 | A | 4/1871 | Ballou |
| 660,962 | A | 10/1900 | Kennedy |
| 3,185,476 | A | 5/1965 | Fechner |

(Continued)

OTHER PUBLICATIONS

Original Drawings from 2006 by Donnie Thompson, http://www.roguefitness.com/rogue-thompson-fatbells, 2006.

(Continued)

*Primary Examiner* — Joshua Lee

(74) *Attorney, Agent, or Firm* — Nexsen Pruet, LLC; Todd A. Serbin

(57) ABSTRACT

A weight-balanced apparatus, comprising: a main body shaped substantially like a hollow sphere with spherical caps removed in a same central axis of the body to create two opposing openings sized to account for the natural motion of a user's arm during exercise and where the main body is balanced in each of at least three dimensions from a center point of the sphere, wherein each of the two opposing openings have a continuous, rotationally symmetric beveled edge around the opening; and, a hand hold traversing centrally through the hollow of the spherical main body through the center point and transverse to the central axis.

18 Claims, 6 Drawing Sheets

(56) References Cited

U.S. PATENT DOCUMENTS

| | | | |
|---|---|---|---|
| D244,628 | S | 6/1977 | Wright |
| D274,283 | S | 6/1984 | Wright |
| 4,575,074 | A | 3/1986 | Damratoski |
| 4,695,051 | A | 9/1987 | Jenison |
| D372,945 | S | 8/1996 | Morgan |
| D438,265 | S | 2/2001 | Fenelon |
| 6,569,066 | B1 | 5/2003 | Patterson et al. |
| D480,438 | S | 10/2003 | Walkow |
| 7,014,598 | B2 | 3/2006 | Fenelon et al. |
| 7,553,259 | B2 | 6/2009 | Landfair |
| 7,878,952 | B2 | 2/2011 | Fenelon |
| 8,382,647 | B1 | 2/2013 | Hodes et al. |
| 8,454,485 | B1 | 6/2013 | Hodes et al. |
| 2003/0032526 | A1 | 2/2003 | Chen |
| 2013/0137556 | A1 | 5/2013 | Farber et al. |
| 2013/0274076 | A1 | 10/2013 | Smith |
| 2014/0024900 | A1 | 1/2014 | Capote et al. |
| 2015/0360074 | A1 | 12/2015 | Jung |

OTHER PUBLICATIONS

Rare 90s Vintage Strongput Non-Grip Technology Hand Weights Dumbbells 5lb Set, http://www.ebay.com/itm/Rare-905-Vintage-Strongput-Non-Grip-Technology-Hand-Weights-Dumbbells-5lb-Set-/151768197451 2016.

1970s Space Weights, Kartell Eames Panton Garfar Corp. 2016.

Webpage Rogue Thompson Fatbells/Rogue Fitness dated Jan. 10, 2017 from http://www.roguefitness.com/rogue-thompson-fatbells Jan. 10, 2017.

Webpage: Indian Nal Stones, shown on the cover of a book at https://www.amazon.com/Physical-Body-Indian-Wrestling-Culture/dp/B000BPZ9U0.

WEIGHT-BALANCED EXERCISE APPARATUSES AND METHODS OF USING SAME

RELATED APPLICATION

This application is a continuation in part of U.S. patent application Ser. No. 14/699,971 filed on Apr. 29, 2015, and claims the benefit of priority pursuant to 35 U.S.C. § 120. The contents of the parent application are incorporated by reference as if fully set forth herein in their entirety.

FIELD AND BACKGROUND OF THE INVENTION

The present invention, in some embodiments thereof, relates to the exercise and fitness industry and, more particularly, but not exclusively, to a manual weightlifting apparatus and methods of using same.

Hand held free weights are often used in modern exercise regimens. Well known hand held weights include dumbbells and kettle bells. Conventionally, dumbbells are provided with a handle with weights positioned on either end of the handle, whereas kettle bells typically feature a single weight with a handle on top or on one side.

These current designs are inherently imbalanced and when held by a user require hand and arm strength just to keep the bells straight during exercise which is additional to the strength being used to repetitively use the bells in an intended exercise motion. The imbalance and unsupported hands and arms being used to stably exercise with dumbbells and kettle bells introduce an additional safety risk that can be avoided, especially at heavier weights, where the problems of these kinds of bells are exacerbated.

SUMMARY OF THE INVENTION

There is provided in accordance with an exemplary embodiment of the invention, a weight-balanced apparatus, comprising: a main body shaped substantially like a hollow sphere with spherical caps removed in a same central axis of the body to create two opposing openings sized to account for the natural motion of a user's arm during exercise and where the main body is balanced in each of at least three dimensions from a center point of the sphere, wherein each of the two opposing openings have a continuous, rotationally symmetric beveled edge around the opening; and, a hand hold traversing centrally through the hollow of the spherical main body through the center point and transverse to the central axis.

In an embodiment of the invention, the apparatus has a height between 5 inches and 10 inches, an outer diameter of 7 inches to 11 inches, and a weight of 5 lbs to 200 lbs.

In an embodiment of the invention, the apparatus has a height of 5.786 inches, an outer diameter of 7.5 inches and a weight of 20 lb.

In an embodiment of the invention, the apparatus has a height of 7.006 inches, an outer diameter of 8.5 inches and a weight of 35 lb.

In an embodiment of the invention, the apparatus has a height of 8.198 inches, an outer diameter of 9.5 inches and a weight of 50 lb.

In an embodiment of the invention, the apparatus has a height of 9.365 inches, an outer diameter of 10.5 inches and a weight of 70 lb.

In an embodiment of the invention, the hand hold is 1.0 to 2.5 inches in maximum diameter.

In an embodiment of the invention, the hand hold is 1.2 to 1.5 inches in maximum diameter.

In an embodiment of the invention, the ratio of the outer diameter squared to the height of the weight is under 21.

In an embodiment of the invention, the ratio of the weight to the square of the outer diameter times the height is under 0.08.

In an embodiment of the invention, the openings have a diameter of 4 inches to 5 inches.

In an embodiment of the invention, the hand hold has a circular cross-section.

In an embodiment of the invention, the hand hold has an oblong cross-section.

In an embodiment of the invention, the hand hold has an ovoid cross-section.

In an embodiment of the invention, the weight-balanced apparatus is of unitary construction.

In an embodiment of the invention, the apparatus is manufactured by casting or injection moulding.

In an embodiment of the invention, the apparatus further comprises a strap interface disposed on the apparatus for enabling pulley exercise with the apparatus.

There is further provided in accordance with an exemplary embodiment of the invention, a method of using a weight-balanced apparatus, comprising: inserting at least one hand into a main body shaped substantially like a hollow sphere with spherical caps removed in a same central axis of the body to create two opposing openings sized to account for the natural motion of a user's arm during exercise and where the main body is balanced in each of at least three dimensions from a center point of the sphere, wherein each of the two opposing openings have a continuous, rotationally symmetric beveled edge around the opening; grabbing a hand hold traversing centrally through the hollow of the spherical main body through the center point and transverse to the central axis; and, exercising by maneuvering the apparatus using the hand hold as the contact point between a user and the apparatus.

In an embodiment of the invention, the inserting includes inserting a first hand into a first opening and inserting a second hand into a second opening such that exercising is performed with the first hand and the second hand holding the hand hold.

In an embodiment of the invention, the method further comprises stacking a plurality of apparatuses and exercising using the plurality of apparatuses simultaneously.

In an embodiment of the invention, the method further comprises repeating exercising.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example, are not necessarily to scale, and are for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
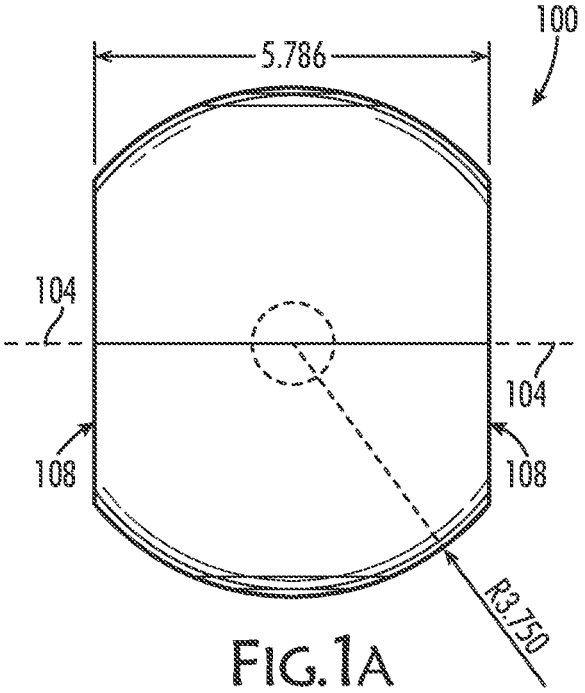
FIG. 1A is a side view of a 20 lb (9.09 kg) Center Mass Bell® weight-balanced apparatus, in accordance with an exemplary embodiment of the invention.

The present invention, in some embodiments thereof, relates to the exercise and fitness industry and, more particularly, but not exclusively, to a manual weightlifting apparatus and methods of using same.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Generally, a manually operated weightlifting apparatus is provided which is useable by any level of user, from a professional athlete to a fitness neophyte. In some embodiments of the invention, user safety, comfort and/or exercise efficiency are enhanced over what is currently available in the art by the weightlifting apparatuses described herein. In an embodiment of the invention, a centrally located hand hold (handle), accessible from at least two sides of the apparatus, creates a weight balanced apparatus which provides a comfortable distribution of weight around the hand and/or ensures there is no weight transfer and/or shifting as is common with traditional hand held weightlifting apparatuses. In an embodiment of the invention, this weight balanced configuration eliminates or at least reduces impact on wrists, hands, shoulders and/or other easily de-stabilized joins or muscle groups. While specific embodiments are described herein, it should be understood that some features and/or characteristics described with respect to one embodiment are capable of being applied to other embodiments.

In an embodiment of the invention, the spherical and/or compact design also provides for movements common to dumbbells without fear of rotating handles and/or dumbbell heads causing instability and/or limiting proper and/or safe range of motion. With a safer more effective range of motion using the Center Mass Bell® apparatuses described herein, the lifter is able to maximize not only their time under stress, but also experience more effective work under tension.

FIG. 1A is a side view of a 20 lb (9.09 kg) Center Mass Bell® weight-balanced apparatus 100, in accordance with an exemplary embodiment of the invention. A main body of the Center Mass Bell® apparatus 100 is shaped substantially like a hollow sphere with spherical caps removed in the same central axis 104, in an embodiment of the invention. In an embodiment of the invention, the size/diameter of the two spherical caps are the same. Optionally, the size/diameter of the two removed spherical caps are not the same. In an embodiment of the invention, the Center Mass Bell® apparatus 100 is manually operated by a user, that is the user grabs the apparatus 100 by a hand hold 102 through at least one opening 108 (opening 108 located on either and opposite sides) and maneuvers it without machine or automated assistance to derive exercise benefit. In an embodiment of the invention, maneuvering is at least one of lifting and lowering the apparatus. The Center Mass Bell® apparatus 100 is configured with the hand hold 102 traversing centrally through the hollow of the spherical main body, shown and described in more detail with respect to FIG. 1B and FIG. 3D. Optionally, the hand hold 102 traverses the hollow substantially transverse to the central axis 104 of the apparatus. In an embodiment of the invention, the hand hold 102 is circular in cross-section. In an embodiment of the invention, the hand hold 102 is oblong or ovoid or any other shape in cross-section. In some embodiments of the invention, the upper and/or inner edges of opening 108 are beveled to enhance user comfort and/or to provide stability and/or to allow for stacking of a plurality of Center Mass Bell® apparatuses 100.

In an embodiment of the invention, the main body and the hand hold are of unitary construction. For example, the main body and hand hold are formed through injection moulding or casting. In an embodiment of the invention, the main body and the hand hold are constructed of a metallic substance, for example iron, steel and/or an iron alloy. Optionally, the apparatus 100 is coated, for example with a polymer and/or rubber.

Figure 1B:
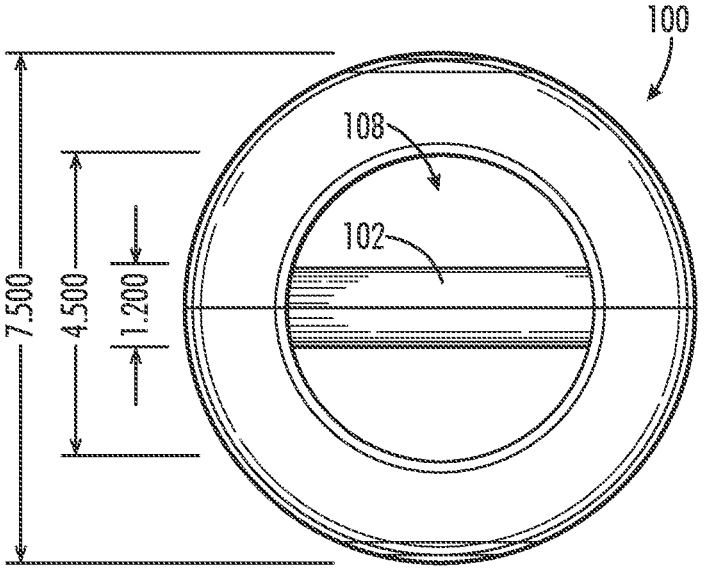
FIG. 1B is a top or bottom view of a 20 lb Center Mass Bell® weight-balanced apparatus, in accordance with an exemplary embodiment of the invention.

FIG. 1B is a top or bottom view of 20 lb Center Mass Bell® weight-balanced apparatus 100, in accordance with an exemplary embodiment of the invention. In an embodiment of the invention, the apparatus is equally balanced in weight in three axes from the center of the apparatus. That is, from the center of the apparatus, the weight distribution is the same in the x, y, and z axes with respect to each other.

In an embodiment of the invention, the Center Mass Bell® weight-balanced apparatus 100 has an approximate height of 5.786 inches (14.7 cm) and a radius from a center point of an imaginary sphere traced by the apparatus 100 of 3.75 inches (9.53 cm) (both shown in FIG. 1A), an outer diameter of approximately 7.5 inches (19.05 cm), and an opening 108 diameter of approximately 4.5 inches (11.43 cm) (both shown in FIG. 1B). In an embodiment of the invention, the hand hold 102 is approximately 1.0-2.5 inches (2.54 cm to 6.35 cm) in maximum diameter. Optionally, the hand hold 102 is 1.2 inches (3.05 cm) in diameter.

It should be understood, that these dimensions are by way of example only, and that in different embodiments the dimensions are larger or smaller as long as three dimensional weight balance is maintained and that the ratio of the outer diameter squared to the height of the weight is under 21 (using English units for calculation, here and throughout) and the ratio of the weight to the square of the outer diameter times the height is under 0.08 (using English units for calculation, here and throughout). Optionally, the ratio of the outer diameter squared to the height of the weight is approximately 9.72. Optionally, the ratio of the weight to the square of the outer diameter times the height is approximately 0.06. In an embodiment of the invention, the opening 108 size is chosen to accommodate not just the insertion of a hand therethrough but to also account for the natural motion of the user's arm during exercise. It should also be understood, and as described elsewhere herein, that in some embodiments of the invention the apparatus 100 can come in any weight as long as the requisite dimensional and/or weight ratios are maintained.

Figure 2A:
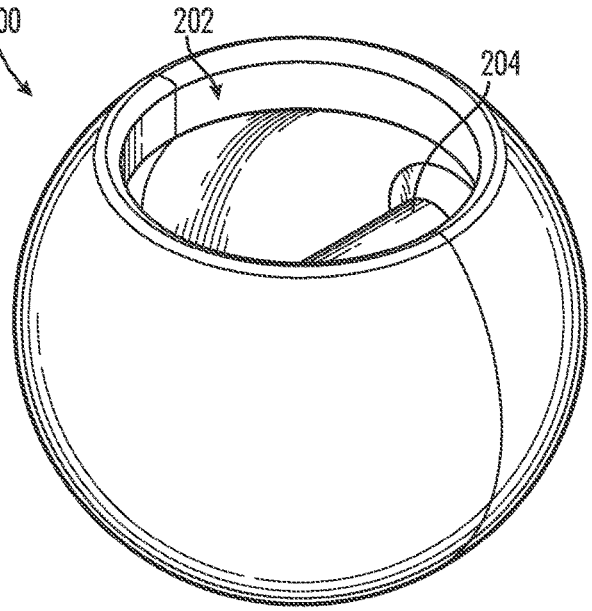
FIG. 2A is a perspective view of a 35 lb (15.91 kg) Center Mass Bell® weight-balanced apparatus, in accordance with an exemplary embodiment of the invention.

FIG. 2A is a perspective view of a 35 lb (15.91 kg) Center Mass Bell® weight-balanced apparatus 200, in accordance with an exemplary embodiment of the invention. It should be understood that each of the Center Mass Bell® apparatuses that are described herein bear similar structural features and for efficiency description will not be repeated for each alternative embodiment. Instead, notable differences in some embodiments of the invention are described.

For example, the Center Mass Bell® apparatus can come in different weights which, in some embodiments of the invention, may alter the dimensions of the apparatus as more material mass is added or subtracted in order to imbue it with more or less weightiness. Increased mass, relative to the center mass bell 100, is optionally effectuated by increasing the size of the apparatus 200, in an embodiment of the invention and/or is thicker and/or has a larger outer diameter. In some embodiments of the invention, the apparatus is made from a more or less dense material and/or the sides themselves are hollow (in addition to having a hollow 306, shown in FIG. 3D).

Figure 2B:
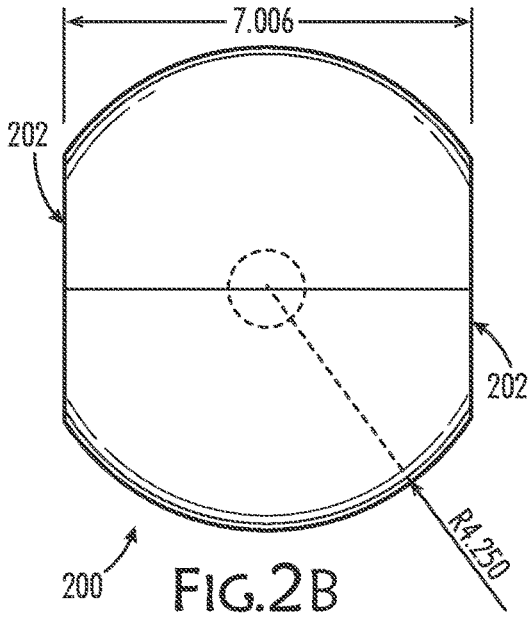
FIG. 2B is a side view of a 35 lb Center Mass Bell® weight-balanced apparatus, in accordance with an exemplary embodiment of the invention.
Figure 2C:
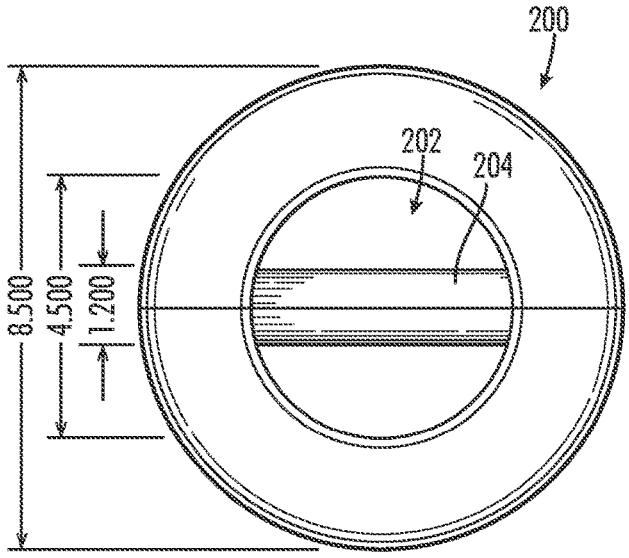
FIG. 2C is a top or bottom view of a 35 lb Center Mass Bell® weight-balanced apparatus, in accordance with an exemplary embodiment of the invention.

In an embodiment of the invention, the Center Mass Bell® apparatus 200 has an approximate height of 7.006 inches (17.8 cm) and a radius from a center point of an imaginary sphere traced by the apparatus 200 of 4.25 inches (10.8 cm)(both shown in FIG. 2B), an external diameter of approximately 8.5 inches (21.59 cm), and an opening 202 diameter of approximately 4.5 inches (both shown in FIG. 2B). In an embodiment of the invention, the hand hold 204 is approximately 1.0-2.5 inches in maximum diameter. In an embodiment of the invention, the hand hold 204 is approximately 1.2 inches in maximum diameter (shown in FIG. 2C).

It should be understood, that these dimensions are by way of example only, and that in different embodiments the dimensions are larger or smaller as long as three dimensional weight balance is maintained and that the ratio of the outer diameter squared to the height of the weight is under 21 and the ratio of the weight to the square of the outer diameter times the height is under 0.08. Optionally, the ratio of the outer diameter squared to the height of the weight is approximately 10.31. Optionally, the ratio of the weight to the square of the outer diameter times the height is approximately 0.069.

Figure 3A:
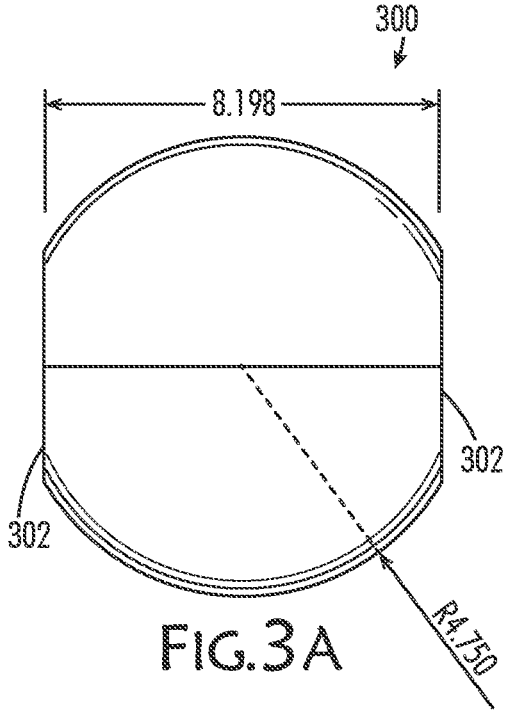
FIG. 3A is a side view of a 50 lb (22.73 kg) Center Mass Bell® weight-balanced apparatus, in accordance with an exemplary embodiment of the invention.
Figure 3B:
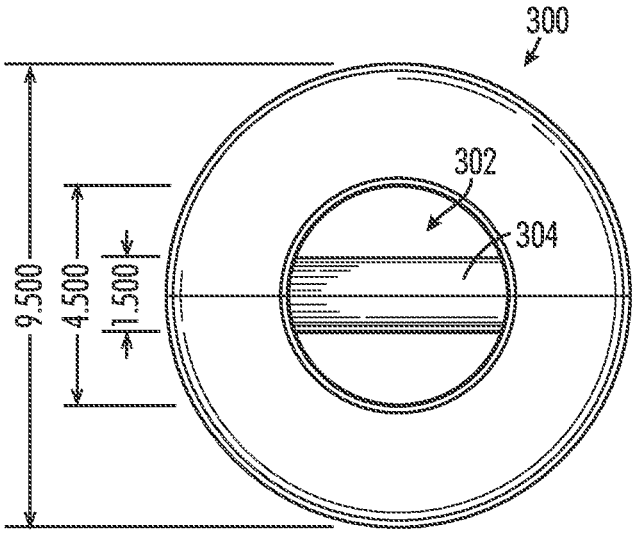
FIG. 3B is a top or bottom view of a 50 lb Center Mass Bell® weight-balanced apparatus, in accordance with an exemplary embodiment of the invention.

FIG. 3A is a side view of a 50 lb (22.73 kg) Center Mass Bell® weight-balanced apparatus 300, in accordance with an exemplary embodiment of the invention. The dimensions for the apparatus 300 are slightly different than for apparatuses 100, 200. In an embodiment of the invention, the Center Mass Bell® apparatus 300 has an approximate height of 8.198 inches (20.82 cm) and a radius from a center point of an imaginary sphere traced by the apparatus 300 of 4.75 inches (12.07 cm), an external diameter of approximately 9.5 inches (24.13 cm), and an opening 302 diameter of approximately 4.5 inches (both shown in FIG. 3B). In an embodiment of the invention, a hand hold 304 is approximately 1.5 inches (3.81 cm) in maximum diameter (also shown in FIG. 3B).

It should be understood, that dimensions described in this application are by way of example only, and that in different embodiments the dimensions are larger or smaller as long as three dimensional weight balance is maintained and that the ratio of the outer diameter squared to the height of the weight is under 21 and the ratio of the weight to the square of the outer diameter times the height is under 0.08. Optionally, the ratio of the outer diameter squared to the height of the weight is approximately 11.01. Optionally, the ratio of the weight to the square of the outer diameter times the height is approximately 0.068.

Figure 3C:
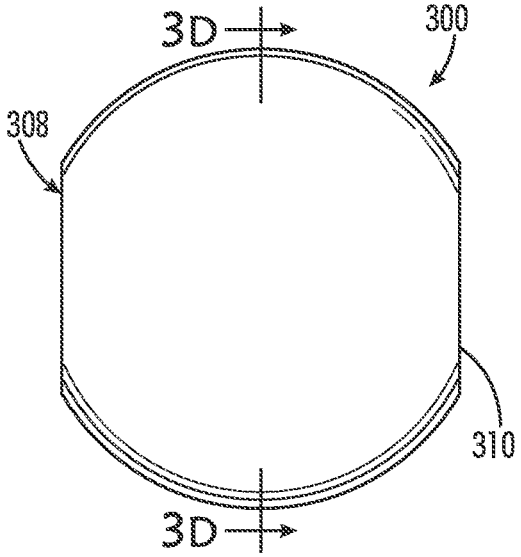
FIG. 3C is a side view of a 50 lb Center Mass Bell® weight-balanced apparatus showing a cross-section A-A of FIG. 3D, in accordance with an exemplary embodiment of the invention.
Figure 3D:
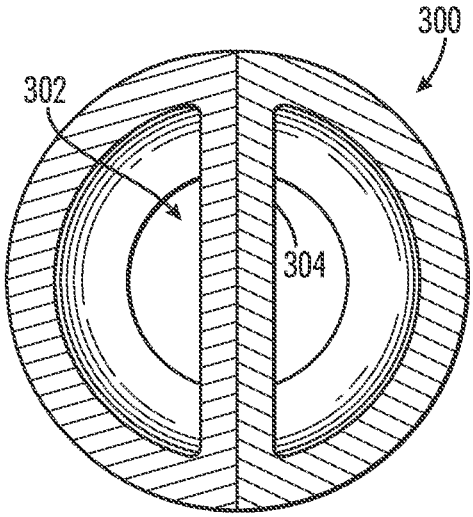
FIG. 3D is the cross-sectional view A-A of a 50 lb Center Mass Bell® weight-balanced apparatus, in accordance with an exemplary embodiment of the invention.

FIG. 3C is a side view of the 50 lb Center Mass Bell® apparatus 300 showing the cross-section A-A of FIG. 3D, in accordance with an exemplary embodiment of the invention. FIG. 3D is the cross-sectional view of the 50 lb Center Mass Bell® apparatus 300, in accordance with an exemplary embodiment of the invention. It should be understood that the cross-sectional views of each of the apparatuses 100, 200, 300, 400 described herein are substantially similar in configuration, with dimensions varying slightly.

In an embodiment of the invention, the hand hold 304 is located in a hollow portion 306 of the apparatus 300 such that the weight of the apparatus is balanced (evenly spread) in three dimensions from the center of the apparatus 300 when the hand hold 304 is gripped by a user, for example the hand hold 304 is located equidistant from the top 308 and bottom 310 and/or is located at the maximum diameter of the imaginary circle circumscribed by the cross-sectional profile of the apparatus 300. Optionally, the hand hold 304 does not extend all the way across and/or unbroken across the hollow 306.

Figure 4A:
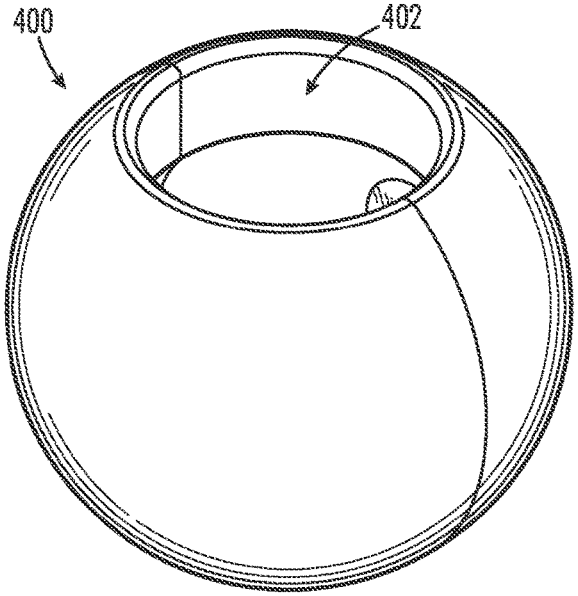
FIG. 4A is a perspective view of a 70 lb (31.82 kg) Center Mass Bell® weight-balanced apparatus, in accordance with an exemplary embodiment of the invention.
Figure 4B:
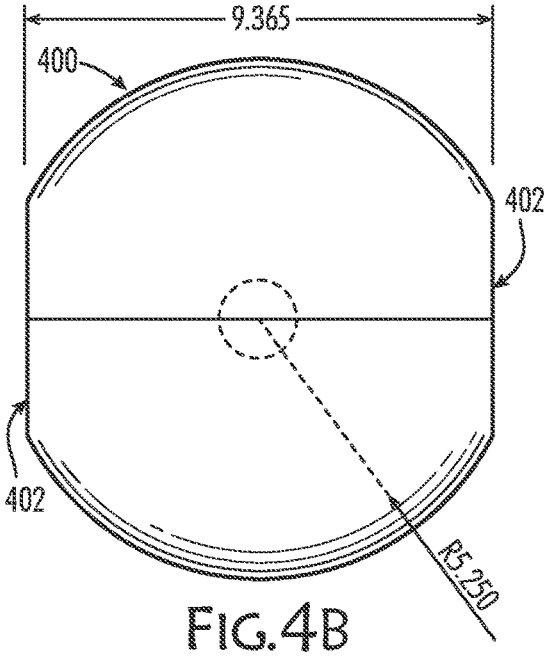
FIG. 4B is a side view of a 70 lb Center Mass Bell® weight-balanced apparatus, in accordance with an exemplary embodiment of the invention.
Figure 4C:
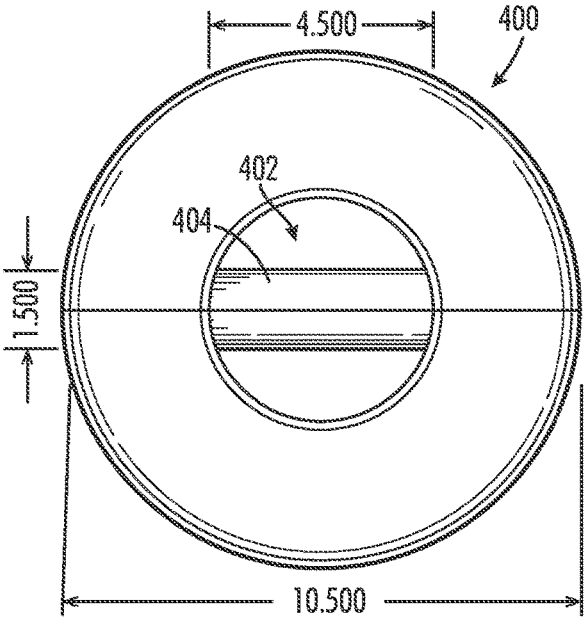
FIG. 4C is a top or bottom view of a 70 lb Center Mass Bell® weight-balanced apparatus, in accordance with an exemplary embodiment of the invention.

FIG. 4A is a perspective view of a 70 lb (31.82 kg) Center Mass Bell® weight-balanced apparatus 400, in accordance with an exemplary embodiment of the invention. The dimensions for the apparatus 400 are slightly different than for apparatuses 100, 200, 300. In an embodiment of the invention, the Center Mass Bell® apparatus 400 has an approximate height of 9.365 inches (23.79 cm) and a radius from a center point of an imaginary sphere traced by the apparatus 400 of 5.25 inches (13.34 cm) (both shown in FIG. 4B), an outer diameter of approximately 10.5 inches (26.67 cm), and an opening 402 diameter of approximately 4.5 inches (both shown in FIG. 4C). In an embodiment of the invention, a hand hold 404 is approximately 1.0-2.5 inches in maximum diameter (also shown in FIG. 4C).

It should be understood, that dimensions described in this application are by way of example only, and that in different embodiments the dimensions are larger or smaller as long as three dimensional weight balance is maintained and that the ratio of the outer diameter squared to the height of the weight is under 21 and the ratio of the weight to the square of the outer diameter times the height is under 0.08. Optionally, the ratio of the outer diameter squared to the height of the weight is approximately 11.77. Optionally, the ratio of the weight to the square of the outer diameter times the height is approximately 0.068.

Figure 5:
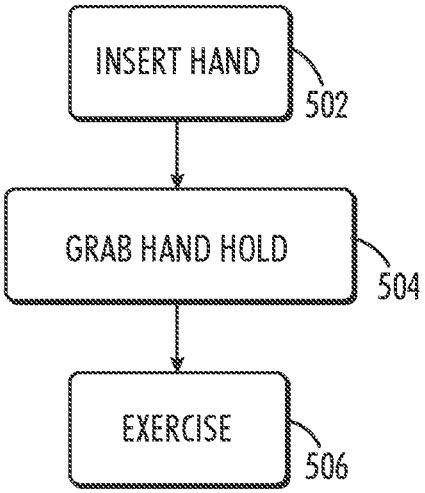
FIG. 5 is a flowchart showing a method of using a Center Mass Bell® weight-balanced apparatus, in accordance with an exemplary embodiment of the invention; and, FIGS. 6A-6C are perspective, rotated side and top/bottom views of a generalized Center Mass Bell® weight-balanced apparatus, in accordance with an exemplary embodiment of the invention.

FIG. 5 is a flowchart 500 showing a method of using a Center Mass Bell® apparatus 100, 200, 300, 400, in accordance with an exemplary embodiment of the invention. In an embodiment of the invention, a lifter/user of the Center Mass Bell® apparatus 300 grabs (504) the hand hold 304 in the center of the apparatus by inserting (502) a hand through an opening to the hollow 306. In an embodiment of the invention, because the Center Mass Bell® apparatus 300 is symmetrical, the user's hand can be inserted either from the top 308 or the bottom 310 of the apparatus in order to grab the hand hold. The user commences exercise (506) by maneuvering the Center Mass Bell® apparatus 300 from the centrally located hand hold as the contact point between the lifter and the apparatus. In an embodiment of the invention, maneuvering comprises lifting and/or lowering the apparatus. Optionally, exercising through maneuvering is repeated. In some embodiments of the invention, because the edges of the apparatuses are beveled at the openings, and they therefore stack evenly onto each other, a plurality of apparatuses can be used simultaneously for exercise. For example, the user having one in each hand and putting them together beveled opening to beveled opening. In some embodiments, each of the user's two hands is placed in one of the opposing openings to grab the hand hold during exercise (506).

Figure 6A:
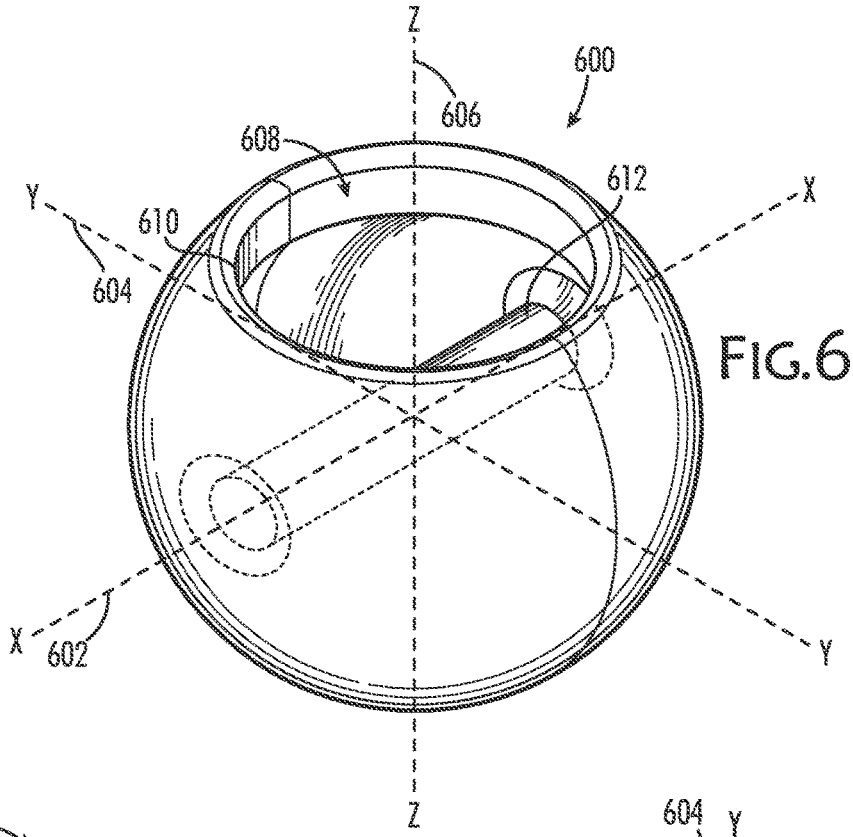
Figure 6B:
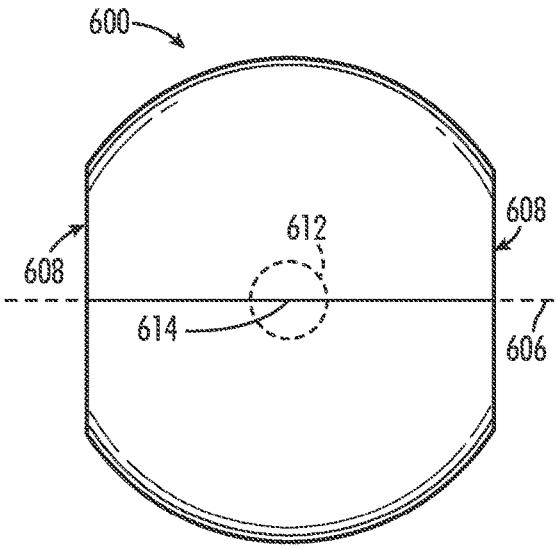
Figure 6C:
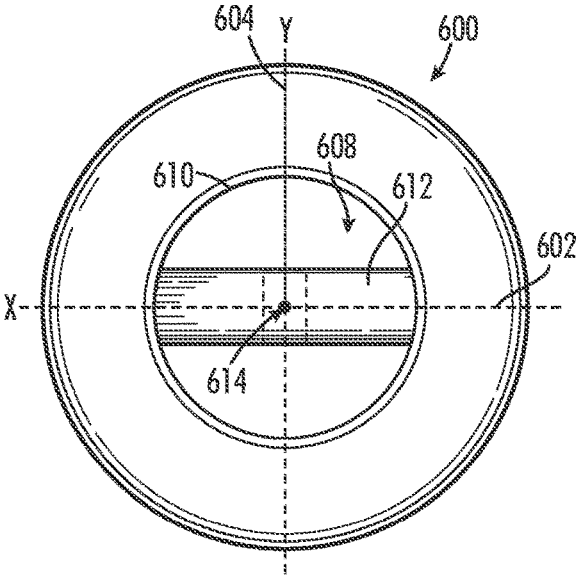

FIGS. 6A-6C are perspective, rotated side and top/bottom views of a generalized Center Mass Bell® weight-balanced apparatus 600, in accordance with an exemplary embodiment of the invention. As mentioned elsewhere herein, the weight-balanced apparatus 600 can exhibit nearly any weight, for example weights in the range of 5 lbs to 200 lbs (2.27 kg to 90.91 kg). While exemplary dimensions for other Center Mass Bell® weight-balanced apparatuses 100, 200, 300, 400 are described above, it should be understood that these are by way of example only, and that the dimensions of weight-balanced apparatus 600 are constrained, in some embodiments of the invention, only to substantially balance the weight of the apparatus 600 in at least three dimensions x 602, y 604 and z 606 such that from the center point of an imaginary sphere created by the apparatus 600, the weight is the same in all directions from that center point to the outer circumference of that imaginary sphere. Exemplary sizes for a range of differently weighted apparatuses 600 from 10 lbs to 100 lbs (4.55 kg to 45.45 kg) can vary from approximately 5 in. to 10 in. (12.7 cm to 25.4 cm) in height and approximately 7 in. to 11 in. (17.78 cm to 27.94 cm) in width, while complying with the previously described ratio of the outer diameter squared to the height of the weight under 21 and the ratio of the weight to the square of the outer diameter times the height under 0.08. The opening 608 size may also vary from 4 in. to 5 in (10.16 cm to 12.7 cm).

In some embodiments of the invention, the opening 608 size is chosen to accommodate not just the insertion of a hand therethrough but to also account for the natural motion of the user's arm during exercise. As with other embodiments described herein, at least one bevel 610 is disposed on the upper and/or inner edges of opening 608 to enhance user comfort and/or to prevent the apparatus 600 from rolling when put down and/or to provide stability and/or to allow for stacking of a plurality of Center Mass Bell® apparatuses 600. Optionally, the bevel 610 is formed at the time of manufacture of the apparatus 600 around the entirety of the opening 608 and/or without any additional pieces or components or materials.

Further, it is conceived that the rotationally symmetrical shape of the opening 608 and bevel 610 means that a user can comfortably grab a hand hold 612 within the apparatus 600 from any angle and use the apparatus 600 from any angle, even if the hand hold 612 orientation with respect to the user may vary.

In some embodiments, weights of the apparatus 600 are expressed on the apparatus 600 itself in English units. Additionally, alternatively and/or optionally, weights are expressed on the apparatus 600 in SI units.

In some embodiments of the invention, the apparatus 600 is of unitary construction and/or is constructed of a single material and/or without additional part or components.

FIG. 6 also shows an optional and/or additional strap interface 614 which is disposed on the apparatus 600 to enable use of the apparatus in a pulley or tethered-weight type of exercise. In some embodiments, the strap interface 614 is a hole which traverses through the hand hold 612 through which a strap or rope or cord can be threaded to enable the apparatus to be suspended by the strap. Optionally, a strap engaging clip, latch or the like is placed through the hole to attach the strap to the apparatus 600. In some embodiments, the strap interface 614 comprises at least one groove, sized and shaped for receipt of the strap, disposed around an outer circumference of the hand hold 612, wherein the strap is placed into the groove and around the hand hold 612 to enable the apparatus to be suspended by the strap. In an embodiment of the invention, the hole and the groove are both included in/on the hand hold 612.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof. Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A weight-balanced apparatus, comprising:

a main body shaped substantially like a hollow sphere with spherical caps removed in a same central axis of the body to create two opposing openings sized to account for a natural motion of a user's arm during exercise and where the main body is balanced in each of at least three dimensions from a center point of the sphere, wherein each of the two opposing openings have a continuous, rotationally symmetric, beveled, upper edge around the opening; and a hand hold traversing centrally through the hollow of the spherical main body through the center point and transverse to the central axis wherein a ratio of the outer diameter squared to the height of the apparatus is under 21 and wherein a ratio of the weight to the square of the outer diameter times the height is under 0.08.

2. The apparatus according to claim 1, having a height between 5 inches and 10 inches, an outer diameter of 7 inches to 11 inches, and a weight of 5 lbs to 200 lbs.

3. The apparatus according to claim 2, having a height of 5.786 inches, an outer diameter of 7.5 inches and a weight of 201b.

4. The apparatus according to claim 2, having a height of 7.006 inches, an outer diameter of 8.5 inches and a weight of 351b.

5. The apparatus according to claim 2, having a height of 8.198 inches, an outer diameter of 9.5 inches and a weight of 501b.

6. The apparatus according to claim 2, having a height of 9.365 inches, an outer diameter of 10.5 inches and a weight of 701b.

7. The apparatus according to claim 2, where the hand hold is 1.0 to 2.5 inches in maximum diameter.

8. The apparatus according to claim 7, where the hand hold is 1.2 to 1.5 inches in maximum diameter.

9. The apparatus according to claim 1, where the openings have a diameter of 4 inches to 5 inches.

10. The apparatus according to claim 1, where the hand hold has a circular cross-section.

11. The apparatus according to claim 1, where the hand hold has an oblong cross-section.

12. The apparatus according to claim 1, where the hand hold has an ovoid cross-section.

13. The apparatus according to claim 1, where the weight-balanced apparatus is of unitary construction.

14. The apparatus according to claim 13, manufactured by casting or injection moulding.

15. The apparatus according to claim 1, further comprising a strap interface disposed on the apparatus for enabling pulley exercise with the apparatus.

16. A method of using a weight-balanced apparatus, comprising:

inserting at least one hand into a main body shaped substantially like a hollow sphere with spherical caps removed in a same central axis of the body to create two opposing openings sized to account for a natural motion of a user's arm during exercise and where the main body is balanced in each of at least three dimensions from a center point of the sphere, wherein each of the two opposing openings have a continuous, rotationally symmetric, beveled, upper edge around the opening, wherein a ratio of the outer diameter squared to the height of the apparatus is under 21, and wherein a ratio of the weight to the square of the outer diameter times the height is under 0.08;

grabbing a hand hold traversing centrally through the hollow of the spherical main body through the center point and transverse to the central axis; and exercising by maneuvering the apparatus using the hand hold as a contact point between a user and the apparatus.

17. The method according to claim 16, wherein inserting includes inserting a first hand into a first opening and inserting a second hand into a second opening such that exercising is performed with the first hand and the second hand holding the hand hold.

18. The method according to claim 16, further comprising stacking a plurality of apparatuses and exercising using the plurality of apparatuses simultaneously.

* * * * *